United States Patent [19]

Foster et al.

[11] 4,239,733

[45] Dec. 16, 1980

[54] CATALYTIC CONVERTER HAVING A MONOLITH WITH SUPPORT AND SEAL MEANS THEREFOR

[75] Inventors: Michael R. Foster, Columbiaville; Jack E. Smith, Grand Blanc, both of Mich.

[73] Assignee: General Motors Corporation, Detroit, Mich.

[21] Appl. No.: 30,125

[22] Filed: Apr. 16, 1979

[51] Int. Cl.[3] ..... F01N 3/28; F01N 7/16; F01N 7/18

[52] U.S. Cl. ..... 422/179; 422/171; 422/180

[58] Field of Search ..... 422/179, 180, 171, 172, 422/176, 177; 60/299; 423/213.2, 213.7

[56] References Cited

U.S. PATENT DOCUMENTS

| | | | |
|---|---|---|---|
| 3,798,006 | 3/1974 | Balluff | 60/299 |
| 3,841,842 | 10/1974 | Wiley | 60/299 |
| 3,854,888 | 12/1974 | Frietzsche et al. | 422/180 |
| 3,876,384 | 4/1975 | Santiago et al. | 422/180 |
| 3,912,459 | 10/1975 | Kearsley | 422/180 |
| 3,915,658 | 10/1975 | Scheitlin et al. | 422/180 |
| 3,948,611 | 4/1976 | Stawsky | 422/180 |
| 3,961,907 | 6/1976 | Close et al. | 422/179 |
| 3,963,445 | 6/1976 | Koyama et al. | 422/180 |
| 3,966,419 | 6/1976 | Bloomfield | 422/180 |
| 3,978,567 | 9/1976 | Vroman | 60/299 |
| 4,020,539 | 5/1977 | Vroman | 60/299 |
| 4,049,388 | 9/1977 | Scheitlin et al. | 422/172 |
| 4,070,158 | 1/1978 | Siebels | 422/180 |

FOREIGN PATENT DOCUMENTS

| | | | |
|---|---|---|---|
| 2324207 | 11/1974 | Fed. Rep. of Germany | 422/180 |
| 2307130 | 11/1976 | France | 422/179 |

*Primary Examiner*—Bradley R. Garris
*Attorney, Agent, or Firm*—R. L. Phillips

[57] ABSTRACT

A catalytic converter having a catalyst coated monolith of frangible material supported in a sheet metal housing by both a wire mesh sleeve and intumescent sleeve with the latter also providing sealing between the monolith and the housing.

2 Claims, 5 Drawing Figures

CATALYTIC CONVERTER HAVING A MONOLITH WITH SUPPORT AND SEAL MEANS THEREFOR

This invention relates to catalytic converters for internal combustion engine exhaust gases and more particularly to such converters of the type having a catalyst coated monolith of frangible material mounted and sealed in a sheet metal housing.

In catalyst converters of the above type, it is well known that the monolith may be supported within the housing without causing fracture thereof and as the housing expands with heat by support means such as a spring steel material or a resilient heat expandable intumescent material or a combination thereof. In the case where only a spring steel material support such as a wire mesh sleeve is used, such wire mesh will provide a leakage path past the monolith which must be sealed as by the addition of a seal element and modification of the housing and/or the monolith to accommodate same. On the other hand, where an intumescent material is used as the monolith support, this material has the added ability of providing sealing between the monolith and the housing. However, the cost of suitable intumescent material at this time is much higher than the wire mesh and as a result, its exclusive use to completely support the monolith is relatively expensive. This has led to attempts to combine the wire mesh with a limited amount of intumescent material to avail of the low cost of the former and both the support and sealing ability of the latter. However, the resiliency characteristics of these metal and intumescent materials are substantially different as to cause problems in implementing their combination while retaining all their advantages in a converter having a sheet metal clamshell type housing and a monolith of cylindrical shape. For example, substantial compression is required of the wire mesh by clamping of the shell members to retain its resilient support of the monolith during heat up whereas the intumescent material of the type contemplated is so dense as to cause fracture of the monolith if similarly compressed during such assembly. On the other hand, the intumescent material must swell sufficiently on first converter heat up without overstressing or bulging the heated housing to provide the tight sealing required yet remain sufficiently compliant if it is to also resiliently suspend the monolith. The presumably obvious solution would be to compromise and suffer some loss in sealing and monolith support by the intumescent material by making its preassembly thickness substantially the same or even smaller than the compressed thickness of the wire mesh at assembly to avoid both fracturing of the monolith and later bulging of the housing when the converter heats up.

The present invention is directed to maintaining the tight sealing and resilient supporting ability of the intumescent material together with the supporting ability of the wire mesh without compromising the abilities of either. This is accomplished with the provision of a cylindrical radially ribbed portion which is formed integral with the housing and extends about the cylindrical surface of the monolith adjacent one end thereof and the adjoining portion of the housing extending about the wire mesh sleeve. The ribbed portion provides a radially stiffened housing portion at this end of the monolith and also an axially confined interior cylindrical surface in the housing. The latter cylindrical surface is thus recessed in the interior of the housing and cooperates with the cylindrical surface of the monolith to provide a radially confined annular seal accommodating space therebetween having partial axial confinement at the housing and a radial width dimension that is substantially larger than that of the space for the wire mesh.

A cylindrical sleeve of resilient heat expandable intumescent material is then provided for mounting in the seal accommodating space. The intumescent sleeve, which has a heat expansion rate substantially greater than that of the housing, is provided with a preassembly radial thickness substantially smaller than that of the wire mesh but only slightly larger by a predetermined amount than the radial width of the seal accommodating space. As a result, the intumescent sleeve is tightly received but only slightly compressed between the housing and the monolith during clamping together of the housing's shell members and then on swelling during first heat up of the converter is resisted by the stiffened housing portion and is caused to exert restraining pressure between this stiffened housing portion and the monolith. This causes the intumescent sleeve to establish and thereafter maintain tight sealing between the housing and the monolith at the one end thereof while remaining sufficiently resilient to assist the wire mesh sleeve in resiliently radially supporting the monolith while also maintaining relative axial location thereof as the housing expands with heat.

These and other objects, features and advantages of the present invention will become more apparent from the following description and drawings in which.

Figure 1:
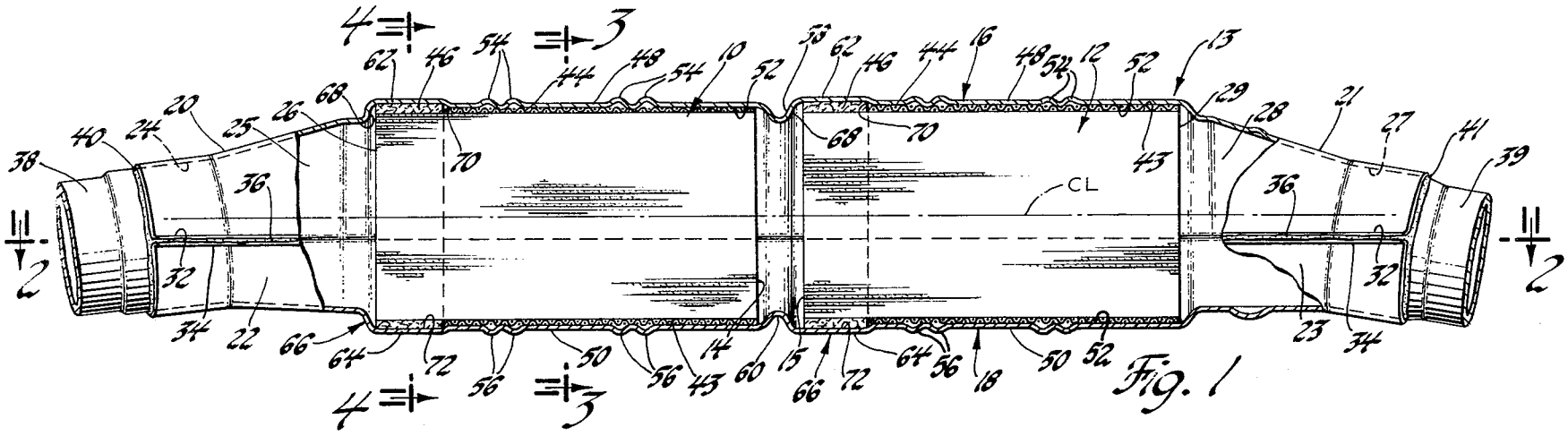
FIG. 1 is a side elevation view with parts broken away of a catalytic converter embodying the present invention.

Referring to the drawings, there is shown a catalytic converter embodying the present invention for use in a vehicle to purify the exhaust gases from an internal combustion engine. The converter generally comprises a pair of monoliths 10 and 12 which are mounted end-to-end in a sheet metal housing 13 of the clamshell type with their respective inner ends 14 and 15 facing each other. The housing 13 consists of a pair of shell members 16 and 18 which cooperatively enclose the peripheral sides of the monoliths and in addition, have integrally formed funnel portions 20, 21 and 22, 23, respectively, at opposite ends thereof. The respective funnel portions 20 and 22 of the shell members 16 and 18 cooperatively form a circular cylindrical opening 24 in one end of the housing and also an internal passage 25 which diverges outwardly therefrom to expose this opening to the entire outer end 26 of monolith 10. The other funnel portions 21 and 23 cooperatively form a circular cylindrical opening 27 in the other end of the housing and also an internal passage 28 which diverges outwardly therefrom to expose this opening to the entire outer end 29 of the other monolith 12. In addition, the respective shell members 16 and 18 have co-planar flanges 32, 33 and 34, 35 which extend along opposite sides and between the ends thereof. The respective flanges 32, 33 mate with the flanges 34, 35 and are permanently, sealingly welded together by separate welds 36 and 37 along the edges thereof.

Figure 2:
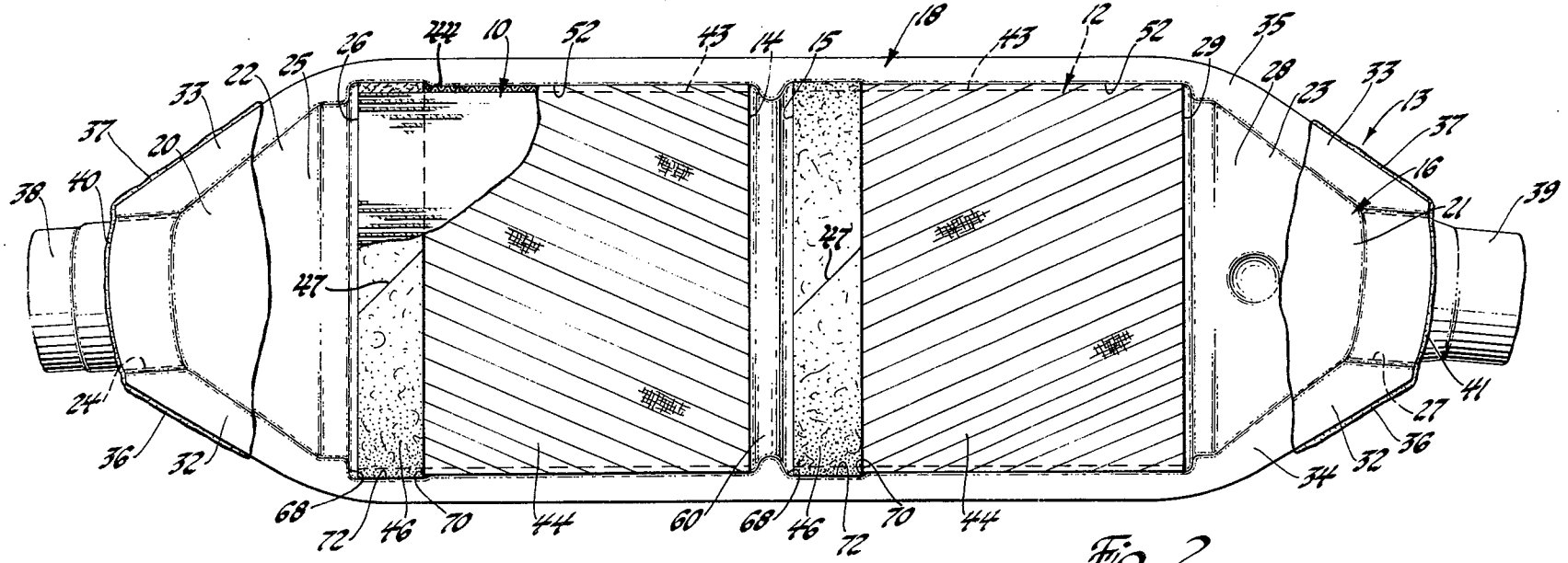
FIG. 2 is a view taken along the line 2—2 in FIG. 1.

Furthermore, for aligning the converter in an under-floor vehicle installation in the exhaust system, it will be observed that the housing openings 24 and 27 are slightly angled downward as viewed in FIG. 1 with the opening 27 further slightly angled sideways as viewed in FIG. 2. Also, the longitudinal split line or plane of the converter housing at its flanges is offset downward from its centerline CL as viewed in FIGS. 1, 3 and 4. This offset is such that the lower shell member 18 is shallow as compared with the upper shell member 16 and that coupled with the downward angling of the openings results in the bottom point of both the housing openings being slightly offset upward from the bottom most point of the converter while the top point of these openings are offset a substantial distance downward from the top-most point of the converter. The housing's respective cylindrical openings 24 and 27 receive a connector pipe 38 and 39, respectively, these pipes are sealingly fixed about their periphery to the edge of the respective housing openings by continuous separate welds 40 and 41 and are adapted to connect the converter in the engine's exhaust system so that the exhaust gases enter to the monolith 10 and exit from the other monolith 12.

Figure 3:
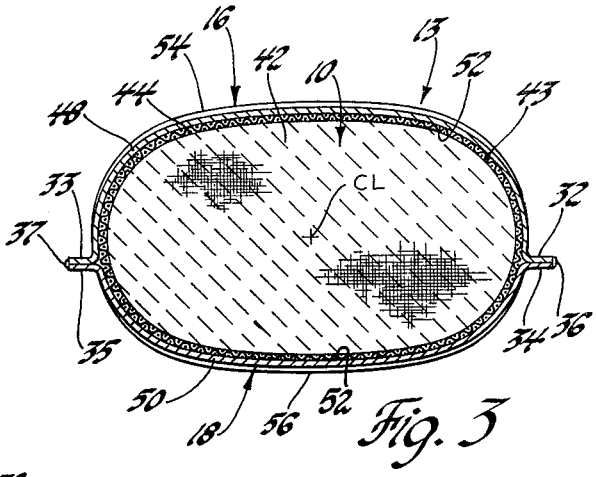
FIG. 3 is a cross-sectional view taken along the line 3—3 in FIG. 1.

The monoliths 10 and 12 are constructed of a frangible material such as ceramic and are extruded with an identical honeycomb cross-section 42 and an oval cylindrical periphery 43 as shown in FIG. 3, such oval shape providing for a low converter profile as compared to width for under-floor vehicle installation where accommodating space height is very limited. The monoliths 10 and 12 are coated with a suitable 3-way reduction, or oxidation catalyst for purifying the exhaust gases entering through the opening 24 serving as the housing inlet and prior to exiting the opening 27 serving as the housing outlet by reduction and oxidation processes as is well-known in the art.

The housing 13 consisting of the shell members 16 and 18 is preferably constructed of stainless steel sheet or some other high temperature non-corrosive metal sheet and thus has a substantially higher rate of thermal expansion than that of the ceramic monoliths 10 and 12. As a result, the housing expands away from the monoliths as the converter heats up and some provision must be made for both supporting and sealing the monoliths to prevent fracture thereof and bypassing or internal leakage of the exhaust gases past their interior.

According to the present invention, each of the monoliths 10 and 12 is separately supported by both a cylindrical wire mesh sleeve 44 woven from stainless steel wire and a cylindrical sleeve 46 of resilient heat expandable intumescent material such as that known by the tradename Interam and made by Technical Ceramics Products Division, 3 M Company. The wire mesh sleeve 44 and intumescent sleeve 46 cooperatively encompass the entire cylindrical surface 43 of the respective monoliths with the axial length of the intumescent sleeve being substantially less than that of the wire mesh sleeve. For example, in the preferred embodiment shown, the axial length of the intumescent sleeve is about one-fifth that of the wire mesh sleeve for the monoliths 10 and 12. Furthermore, for convenience of manufacture both the wire mesh sleeve and the intumescent sleeve are made from sheet stock and are thus split with the former split longitudinally and the latter split diagonally along a straight line 47.

To then make full use of these different type monolith supports, the respective housing shell members 16 and 18 are formed with intermediate partial-cylindrical portions 48 and 50 which are partial-oval in cross-section as viewed in FIG. 3 and cooperatively provide on their interior side an oval cylindrical surface 52 which corresponds to and is spaced radially outward from the surface 43 of the respective monoliths so as to define a cylindrical space therebetween in which the wire mesh sleeve 44 is compressingly mounted separate from its adjacent intumescent sleeve. For increased housing stiffness to resist bulging out in this area on converter heat up, the respective housing portions 38 and 50 have integrally formed pairs of axially spaced, laterally extending ribs 54 and 56. And for increased housing stiffness between the two monoliths, the respective shell members 16 and 18 are further formed with partial-annular rib portions 58 and 60 which extend slightly radially inward of the edges of the inner ends 14 and 15 of the monoliths.

Figure 5:
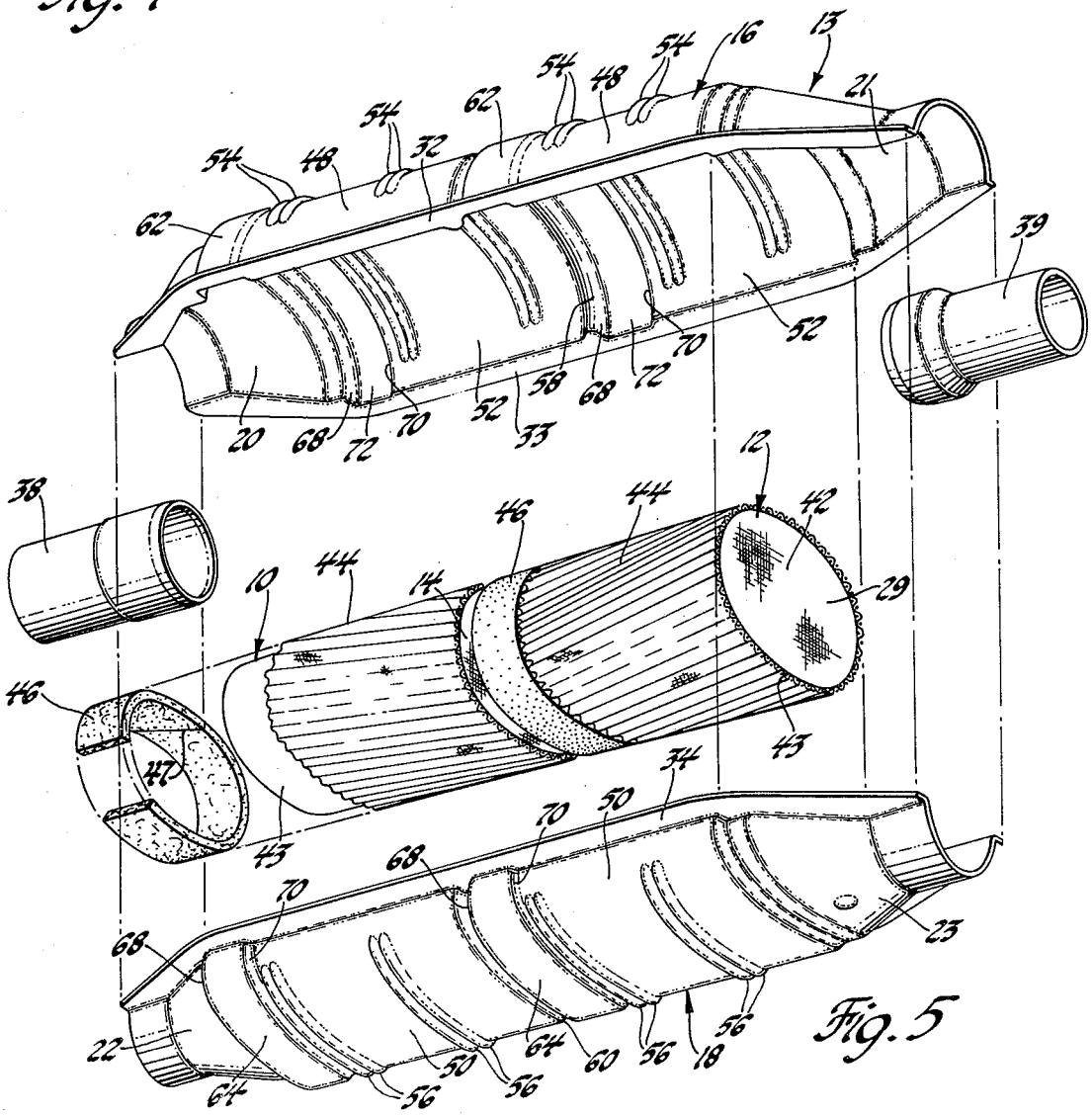
FIG. 5 is an exploded view of the converter in FIG. 1.

The wire mesh sleeve 44 prior to assembly has a radial thickness substantially larger than the radial width of the wire mesh accommodating space so that when the wire mesh sleeve is first mounted about its respective monolith as shown in FIG. 5 and this subassembly is then clamped between the shell members 16 and 18, the wire mesh will be compressed a certain amount. This spring compression is determined so that the monolith is resiliently radially supported and restrained against relative axial movement in the housing by the wire mesh sleeve at atmospheric temperature conditions and then when the converter is heated up during use in the vehicle and as the housing expands radially away from the monolith, the wire mesh expands therewith to retain such resilient radial support and axial location of the monolith within the housing. For example, in an actual construction of the embodiment shown and with the converter housing at atmospheric temperature this effect was provided when the housing had an average radial growth with heat of about 0.020 inches by a radial spacing between the monolith and the housing of about 0.090 inches and compression of the wire mesh sleeve within this space from a preassembly radial thickness of about 0.250 inches.

Figure 4:
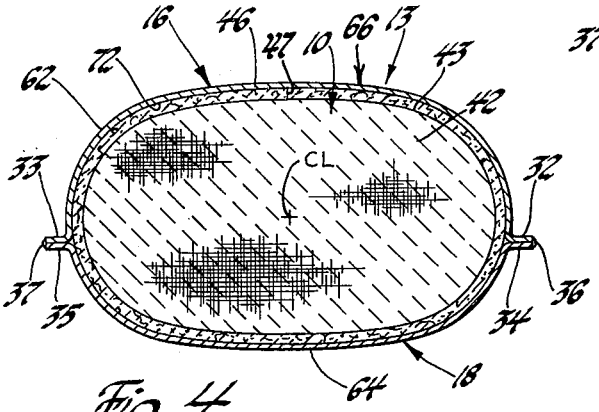
FIG. 4 is a cross-sectional view taken along the line 4—4 in FIG. 1.

On the other hand, the intumescent sleeve 46 which preferably has a rectangular cross-section as seen in FIG. 1 is intended to swell on first converter heat up to provide tight sealing but has less resiliency and compliance than the wire mesh sleeve 44 for support of the monolith. According to the present invention, its manner of mounting including the housing sizing therefor is substantially different from that of the wire mesh sleeve previously described so that it is effective to provide both tight sealing between the housing and monolith while also assisting the wire mesh sleeve in radially supporting and axially retaining the monolith as the housing expands with heat. This is accomplished by forming radially outwardly projecting partial-cylindrical portions 62 and 64 integral with the respective shell members 16 and 18. These housing portions 62 and 64 have a partial-oval cross-section as seen in FIG. 4 and cooperatively provide a radially ribbed cylindrical portion 66 integral with the housing extending about the cylindrical surface 43 of the respective monoliths adjacent their inlet end and adjoining the cylindrical housing portion 48, 50 extending about the wire mesh sleeve. The two radial rib portions 68 and 70 of the cylindrical portion 66 radially stiffen the housing at the inlet end of the respective monoliths and also partially axially confine an interior cylindrical surface 72 on the interior side of the cylindrical portion 66 which corresponds to and is spaced radially outward from the surface 43 of the respective monoliths. The interior cylindrical housing surface 72 cooperates with the cylindrical surface 43 of the monolith to provide a radially confined annular seal accommodating space therebetween having partial axial confinement at the housing as provided by the radial rib portions 68 and 70.

The seal accommodating space differs from the wire mesh sleeve accommodating space in having a radial width dimension prior to converter heat up that is substantially larger than that of the space for the wire mesh sleeve but is only slightly smaller than the radial thickness of the intumescent sleeve 46. For example, in the previously described actual construction of the embodiment shown, the seal accommodating space was then provided with a radial width dimension of about 0.130 inches as compared to the 0.090 inches space for the wire mesh and the radial thickness of the intumescent sleeve 46 as will now be discussed. The intumescent sleeve 46 which has an expansion rate substantially greater than that of the housing is determined to have a preassembly radial thickness substantially smaller than that of the wire mesh sleeve but only slightly larger by a predetermined amount than the radial width dimension of the seal accommodating space so as to prevent fracturing of the monolith at assembly while allowing sufficient bulk density of this material in the seal accommodating space for subsequent support and sealing of the monolith as the converter housing expands with heat. For example, in the previously described actual construction of the embodiment shown, the inumescent sleeve 46 was then provided with a preassembly radially thickness of about 0.185 inches which could freely radially expand with heat to about 0.500 inches if not constrained as compared to the 0.130 inches space in which it is to be clamped and the average radial housing growth of 0.020 inches that occurs with heat.

The intumescent sleeve 46 is subassembled on each of the monoliths like the wire mesh sleeve 44 as shown in FIG. 5 and together therewith is received between the shell members 16 and 18. However, because of the difference in the preassembly radial thickness of the wire mesh sleeve 44 and the intumescent sleeve 46 at each of the monoliths as described above, the latter is only tightly received rather than substantially compressed between the housing and the monolith during assembly of the converter. As a result, the intumescent sleeve 46 at each of the monoliths is thereby prevented from transmitting clamping forces from the shell members large enough to fracture the monolith while the wire mesh sleeve is being compressed its required amount on bringing together of the shell members' flanges. With the converter thus assembled and then on its first heat up in the vehicle, the intumescent sleeve 46 at each of the monoliths swells and is resisted by the stiffened housing portion 66 and is thereby caused to exert substantial restraining pressure between the stiffened housing and the monolith without fracturing the monolith and without causing bulging of the heated housing because of such increased radial stiffening of the latter. Thereafter, the intumescent sleeve 46 remains effective to provide tight sealing between the housing and the monolith at the inlet end thereof while also remaining sufficiently resilient to assist the adjacent wire mesh sleeve 44 in providing resilient radial support of the monolith and also relative axial location thereof as the housing expands with heat.

While a preferred embodiment of the invention has been illustrated, it will be appreciated that modifications are in the spirit and scope of the invention. For example, the intumescent seal and support arrangement is preferably provided at the inlet end of the monolith and out of the path of the oncoming exhaust gases so that the intumescent material and the wire mesh and surrounding housing are not directly exposed to the full heat of the oncoming exhaust gases and, instead, exhaust gases tend to be drawn away from the wire mesh and surrounding housing and the backend of the intumescent material by venturi effect at the outlet end of the monolith. However, it is contemplated that the location of the intumescent seal and support arrangement could be reversed for certain reasons to the outlet end of the monolith where the sealing would be retained and any increased heat caused by the resulting direct impingement of the exhaust gases on the wire mesh and surrounding housing would be tolerable. Furthermore, the intumescent sleeve may be diagonally split and formed from flat material as shown for ease of manufacture or it could be formed as an endless piece such as for convenience of assembly. In addition, the oval shape of the monoliths while providing for a low profile converter also helps to prevent rotation of the monolith within the housing; however, the monolith could be formed of some other cross-sectional shape such as circular with the intumescent seal and support arrangement modified accordingly since the intumescent material has been found to provide a very effective means of also preventing rotation of the monolith in addition to providing resilient radial and axial restraint thereof.

Thus, the above described preferred embodiment is intended to be illustrative of the invention which may be modified within the scope of the appended claims.

The embodiments of the invention in which an exclusive property or privilege is claimed are defined as follows:

1. In a catalytic converter for internal combustion engine exhaust gases and of the type having a catalyst coated monolith of frangible material and cylindrical shape supported about the cylindrical surface thereof in a correspondingly shaped portion of a sheet metal clamshell type housing by a wire mesh sleeve which is mounted in the cylindrical space therebetween and is radially compressed a predetermined amount during converter assembly so as to retain resilient radial support and also relative axial location of the monolith as the housing expands with heat: the improvement comprising in combination, a radially ribbed cylindrical portion integral with the housing extending about the cylindrical surface of the monolith adjacent one end thereof and adjoining the portion of the housing extending about the wire mesh sleeve, said ribbed portion providing a radially stiffened housing portion at said one end of the monolith and also an axially confined interior cylindrical surface in the housing, said axially confined interior cylindrical housing surface cooperating with the cylindrical surface of the monolith to provide a radially confined annular seal accommodating space therebetween having partial axial confinement at the housing and a radial width dimension prior to converter heat up that is substantially larger than that of the space for the wire mesh sleeve, and cylindrical seal means of resilient heat expandable intumescent material for mounting in said seal accommodating space, said seal means having an expansion rate substantially greater than that of the housing and a preassembly radial thickness substantially smaller than that of the wire mesh sleeve but larger by a predetermined amount than said radial width dimension of said seal accommodating space so that the seal means is tightly received between the housing and the monolith during assembly of the converter and then in swelling on first heat up of the converter is resisted by said stiffened housing portion and is caused to exert restraining pressure between said stiffened housing portion and the monolith to establish and thereafter maintain tight sealing between the housing and monolith at the one end thereof while also remaining sufficiently resilient to assist the wire mesh sleeve in providing resilient radial support of the monolith and also relative axial location thereof as the housing expands with heat.

2. In a catalytic converter for internal combustion engine exhaust gases and of the type having a catalyst coated monolith of frangible material and cylindrical shape supported about the cylindrical surface thereof in a correspondingly shaped portion of a sheet metal clamshell type housing by a wire mesh sleeve which is mounted in the cylindrical space therebetween and is radially compressed a predetermined amount during converter assembly so as to retain resilient radial support and also relative axial location of the monolith as the housing expands with heat: the improvement comprising in combination, a radially ribbed cylindrical portion integral with the housing extending about the cylindrical surface of the monolith adjacent the inlet end thereof and adjoining the portion of the housing extending about the wire mesh sleeve, said ribbed portion providing a radially stiffened housing portion at said inlet end of the monolith and also an axially confined interior cylindrical surface in the housing, said axially confined interior cylindrical housing surface cooperating with the cylindrical surface of the monolith to provide a radially confined annular seal accommodating space of rectangular cross-section therebetween having partial axial confinement at the housing and a radial width dimension prior to converter heat up that is substantially larger than that of the space for the wire mesh sleeve, a cylindrical seal means of resilient heat expandable intumescent material for mounting in said seal accommodating space, said seal means having a rectangular cross-section and an expansion rate substantially greater than that of the housing and a preassembly radial thickness substantially smaller than that of the wire mesh sleeve but larger by a predetermined amount than said radial width dimension of said seal accommodating space so that the seal means is tightly received between the housing and the monolith during assembly of the converter and then in swelling on first heat up of the converter is resisted by said stiffened housing portion and is caused to exert restraining pressure between said stiffened housing portion and the monolith to establish and thereafter maintain tight sealing between the housing and monolith at the one end thereof while also remaining sufficiently resilient to assist the wire mesh sleeve in providing resilient radial support of the monolith and also relative axial location thereof as the housing expands with heat.

* * * * *